US010266373B2

(12) United States Patent
Zou et al.

(10) Patent No.: US 10,266,373 B2
(45) Date of Patent: Apr. 23, 2019

(54) AUTOMATIC RESETTING STEEL WIRE ROPE BRAKE

(71) Applicant: HANGZHOU HUNING ELEVATOR PARTS CO., LTD., Hangzhou, Zhejiang (CN)

(72) Inventors: Jiachun Zou, Zhejiang (CN); Rongkang Yao, Zhejiang (CN); Hongxing Meng, Zhejiang (CN); Liming Lu, Zhejiang (CN); Dong Yang, Zhejiang (CN)

(73) Assignee: HANGZHOU HUNING ELEVATOR PARTS CO., LTD., Hangzhou, Zhejiang (CN)

( * ) Notice: Subject to any disclaimer, the term of this patent is extended or adjusted under 35 U.S.C. 154(b) by 141 days.

(21) Appl. No.: 15/121,297

(22) PCT Filed: Dec. 8, 2014

(86) PCT No.: PCT/CN2014/093250

§ 371 (c)(1),
(2) Date: Aug. 24, 2016

(87) PCT Pub. No.: WO2016/058255

PCT Pub. Date: Apr. 21, 2016

(65) Prior Publication Data

US 2017/0217728 A1 Aug. 3, 2017

(30) Foreign Application Priority Data

Oct. 14, 2014 (CN) ..... 2014 1 0541362
Oct. 14, 2014 (CN) ..... 2014 2 0594415 U

(51) Int. Cl.
*B66B 5/24* (2006.01)

(52) U.S. Cl.
CPC ..... *B66B 5/24* (2013.01)

(58) Field of Classification Search
CPC ..... B66B 5/24; B66B 5/185
See application file for complete search history.

(56) References Cited

U.S. PATENT DOCUMENTS 8,511,437 B2 * 8/2013 Glaser ..... B66B 5/185 187/254
8,973,717 B2 * 3/2015 Bae ..... B66B 5/185 187/350

FOREIGN PATENT DOCUMENTS

CN 2517718 Y 10/2002
CN 2858602 Y 1/2007
(Continued)

OTHER PUBLICATIONS

International Search Report of PCT Patent Application No. PCT/CN2014/093250 dated Feb. 27, 2015.

*Primary Examiner* — Diem M Tran
(74) *Attorney, Agent, or Firm* — NK Patent Law

(57) ABSTRACT

The present invention discloses an automatic resetting steel wire rope brake, which comprises two side plates, a fixed brake plate, a moving brake plate, two sides of the moving brake plate are respectively and rotatably matched with one end of a link arm, and the moving brake plate can do translational motion towards or away from the fixed brake plate under the drive of the two link arms; two ends of the sliding axle are respectively in sliding fit with arc-shaped grooves of the two side plates; a hooking part is formed on a swing-type latch hook, and is used for hooking and locking the sliding axle. According to the automatic resetting steel wire rope brake disclosed by the present invention, elevator ascending and descending over-speed protection and car accidental movement protection can be realized simultaneously.

20 Claims, 11 Drawing Sheets

(56) References Cited

FOREIGN PATENT DOCUMENTS

| | | | |
|---|---|---|---|
| CN | 101072723 | A | 11/2007 |
| CN | 103086225 | A | 5/2013 |
| CN | 203568625 | U | 4/2014 |

* cited by examiner

AUTOMATIC RESETTING STEEL WIRE ROPE BRAKE

TECHNICAL FIELD

The present invention pertains to the field of mechanical manufacturing technologies, relates to an elevator safety brake apparatus, and more particularly, to an automatic resetting steel wire rope brake.

BACKGROUND

At present, a steel wire rope brake used in an elevator is mainly used as an elevator safety device of up-direction over speeding. It is adopted a mode of power-on triggering action at failure and manual mechanical resetting. There are objections between its control principle and the current standard requirements, meanwhile it is unable to meet relevant requirements for car accidental movement protection device in term of triggering control mode. Besides, in terms of resetting mode, implementation of resetting by means of manual operation is unable to meet a user's normal use requirements. In addition, the friction brake lining is small in friction coefficient, quick-wearing and short in life, and thus is also unable to meet the requirements for brake life in car accidental movement. For this purpose, an improved design is required for the existing steel wire rope brake to make it more in line with standards, perfect in function, optimized in performance and more stable in control.

By means of information retrieval of the prior art, it is found that the existing steel wire rope brake is designed based on the upgoing overspeed protection, dominated by a mechanical manual resetting mode. It is extremely inconvenient for resetting for limited operation space, higher storey and brake of an elevator without machine room. In addition, during a power-on triggering, intermediate control mechanisms are increased, control delay is long, larger electric current is required for the electromagnet, and a back-up power supply is large in capacity and high in power consumption. Therefore, the control principle, braking force and brake lining life are not suitable for car accidental movement protection. An improved design is required for the resetting mode, the triggering mode, the braking force, the control principle and so on so as to meanwhile meet the upgoing overspeed protection function and car accidental movement protection function.

SUMMARY

In order to overcome deficiencies of the prior art, the present invention provide an automatic resetting steel wire rope brake, by which, elevator ascending and descending over-speed protection and car accidental movement (free-wheeling with a car door open) protection can be realized simultaneously.

The present invention is implemented through following technical solution: an automatic resetting steel wire rope brake, wherein comprising: two side plates, a fixed brake plate, a moving brake plate, a motor lead screw and push block resetting mechanism, an electromagnet resetting mechanism and an electromagnetic triggering mechanism, the fixed brake plate and the moving brake plate are arranged in parallel, and an interval is kept between opposite clamping surfaces of the fixed brake plate and the moving brake plate; two sides of the moving brake plate are respectively and rotatably matched with one end of a link arm, and the moving brake plate can do translational motion towards or away from the fixed brake plate under a drive of the two link arms; the other end of each of the two link arms is rotatably matched with one end of a sliding axle; two ends of the sliding axle are respectively in sliding fit with arc-shaped grooves of the two side plates; a swing-type latch hook is provided, and the latch hook forms a hooking part used for hooking and locking a sliding axle; a swing end of the latch hook is triggered by an electromagnetic or mechanical triggering mechanism to enable the swing end to release the sliding axle; the motor lead screw and push block resetting mechanism promoted by the electromagnet resetting mechanism reset the electromagnetic triggering mechanism, the latch hook, the sliding axle and the moving brake plate.

Preferably, the motor lead screw and push block resetting mechanism includes a push block, a screw, a lead screw and a motor, the motor drives an upper end of lead screw, a lower end of the lead screw is rotatably connected with the screw and movably penetrate through the push block, the screw is fixed on an upper surface of the push block, and a bottom inclined surface of the push block directly faces and props against the sliding axle.

Preferably, the sliding axle transversely penetrates through an upper spring seat; between the two side plates there is provided a spring support shaft on which a lower spring seat is mounted, the upper spring seat is corresponding to the lower spring seat in upper and lower positions, and an energy storage spring is provided between the upper spring seat and the lower spring seat.

Preferably, the electromagnetic triggering mechanism includes an electromagnet, an impact bar, a nut and a buffer cushion, where the impact bar longitudinally penetrates through an iron core of the electromagnet, the iron core of the electromagnet is linked with the impact bar, a part of the impact bar is externally sleeved with a compression spring, an upper end of the impact bar is provided with the buffer cushion and is screwed with the nut, the buffer cushion directly faces an upper surface of an external housing of the electromagnet; and a lower end of the impact bar is provided with the buffer cushion and an impact screwhead which directly faces and downward props against the swing end of the latch hook.

Preferably, the push block is fixedly connected with a slide block, a guide rail longitudinally penetrates through the slide block and is in sliding fit with the slide block; the electromagnet resetting mechanism includes a pin shaft, a support rod, a tension spring, a spring guide holder and a support on which the support rod that can rotate is mounted, an external end of the support rod forms a pin hole, the pin shaft transversely penetrates through the pin hole of the support rod, one end of the pin shaft is connected to one end of the tension spring, the other end of the tension spring is connected to the swing end of the latch hook; the pin shaft is also connected to the spring guide holder which is connected to a lower end of the impact bar; and an inner end of the support rod directly faces a lower surface of the slide block, and when the slide block moves downward, the lower surface of the slide block props against the inner end of the support rod to make the support rod swing.

Preferably, the fixed brake plate is fixedly provided with a latch hook rack which rotatably assembles the latch hook through the pin shaft.

Preferably, the moving brake plate is fixedly connected to two fixed axle plates, a link arm shaft is assembled between the two fixed axle plates, and two ends of the link arm shaft are respectively and rotatably matched with one end of the two link arms.

Preferably, the two side plates are respectively and rotatably matched with one mounting plate by means of a pivot screw, after adjusting a mounting angle, the two side plates are fixedly connected with the mounting plate; and the mounting plate is fixed to a cross beam of an elevator car.

Preferably, an outer side surface of the moving brake plate is provided with two fixed axle plates, a link arm shaft penetrates through the two fixed axle plates and is fixedly connected by means of a fixed pin; the moving brake plate is also provided with a support pin which faces an outside of the moving brake plate and is positioned below the link arm shaft to prevent the link arm shaft from sliding down in a brake process.

Preferably, a safety switch is provided, when the impact bar of the electromagnet impacts the latch hook, the latch hook moves down to turn on the safety switch, and is connected to an elevator safety circuit by means of the safety switch.

Preferably, a rear side plate is provided with the safety switch.

Preferably, the electromagnet is mounted on an electromagnet seat, the electromagnet seat is mounted on a fixed plate which is mounted on the rear side plate, and the rear side plate is mounted on a rear side surface of the steel wire rope brake.

Preferably, the fixed brake plate is mounted on a left side plate and a right side plate.

Preferably, each of the two side plates is provided with a pin, correspondingly, pin holes are formed on the fixed brake plate, and the pins are corresponding to and fixedly connected with the pin holes on the fixed brake plate; a plurality of fixed plate connecting holes are respectively formed at a front side edge of each of the two side plates, the front side edges of the two side plates fit with the fixed brake plate, and bolts penetrate through the fixed brake plate and then are screwed into the fixed plate connecting holes.

Preferably, an adjusting shim is provided between the fixed axle plate and the moving brake plate.

Preferably, the fixed brake plate is connected with the moving brake plate through a guiding shaft.

Preferably, the motor drives the lead screw through a gear reducer, and a transmission shaft of the gear reducer is connected to an upper end of the lead screw by means of a coupled axle-sleeve.

Preferably, a brake lining is respectively assembled on the clamping surface of the fixed brake plate and of the moving brake plate, the brake lining protrudes above the clamping surface of the fixed brake plate and of the moving brake plate, and the two brake linings form longitudinal arc-shaped grooves fitting with an external shape of the steel wire rope.

Preferably, the fixed brake plate and the moving brake plate form, toward an opposite side surface, two cuboid-shaped recessed parts respectively extending to an upper edge and a lower edge of the fixed brake plate and the moving brake plate, two side edges of each of the recessed parts are brake plate table facets, and a same side of each of the recessed parts is provided with a brake lining adjusting hole; correspondingly, the brake lining forms the recessed part whose edge is a brake lining table facet fitting with the brake plate table facets, the brake lining is embedded between the two recessed parts of the fixed brake plate and the moving brake plate, and the table facets both come into contact, a width of the table facet at two sides fits with that of the brake lining, and both are fixed by screwing bolts into the brake lining adjusting holes.

Preferably, the brake linings are formed by selecting and vertically and parallelly arranging multiple brake linings, and each of the brake linings is fixedly connected with the fixed brake plate and the moving brake plate through bolts.

Preferably, the brake lining adjusting hole is an elongated hole.

In the present invention, the performance of the steel wire rope brake is improved by means of upgrading of function, and its advantages reside in that elevator ascending and descending over-speed protection and car accidental movement protection functions are integrated, and two safety protection problems can be solved by using one device. The original power-on action is changed to a power-loss action. In this way, it is solved the problem that after an external power supply is lost, the protective device is still in a working state, and the car is maintained in a stop position; the power-loss triggering mechanism reduces intermediate control links, makes two electromagnets simultaneously act on the latch hook, reduces time delay, improves the control reliability, and implements automatic resetting of the electromagnet and the triggering mechanism. The resetting modes of the triggering mechanism and the energy storage spring are changed to automatic resetting, thereby solving the problem that the triggering mechanism and the energy storage spring are mounted somewhere inaccessible without remote resetting function and thus it is unable to meet standards. In addition, by means of structural improvement of the brake friction lining and moving (fixed) brake plate, the present invention also makes it convenient for installation and maintenance, and stable and controllable in manufacturing; meanwhile, the improvement of the friction lining improves the stability of the brake friction lining, and makes the brake perfect in function, optimized in performance and more stable in control.

Figure 1:
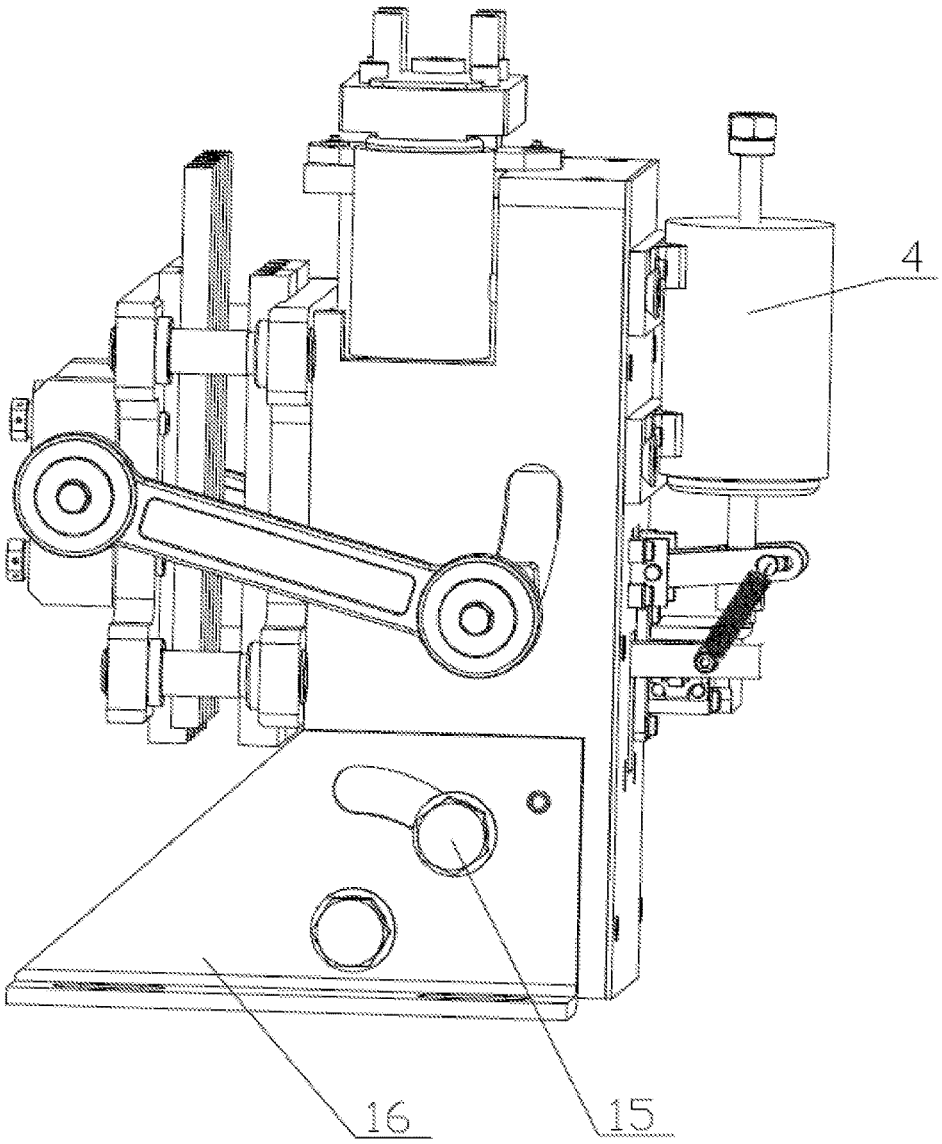
FIG. 1 is a schematic diagram of an appearance structure of a steel wire rope brake according to the present invention.
Figure 2:
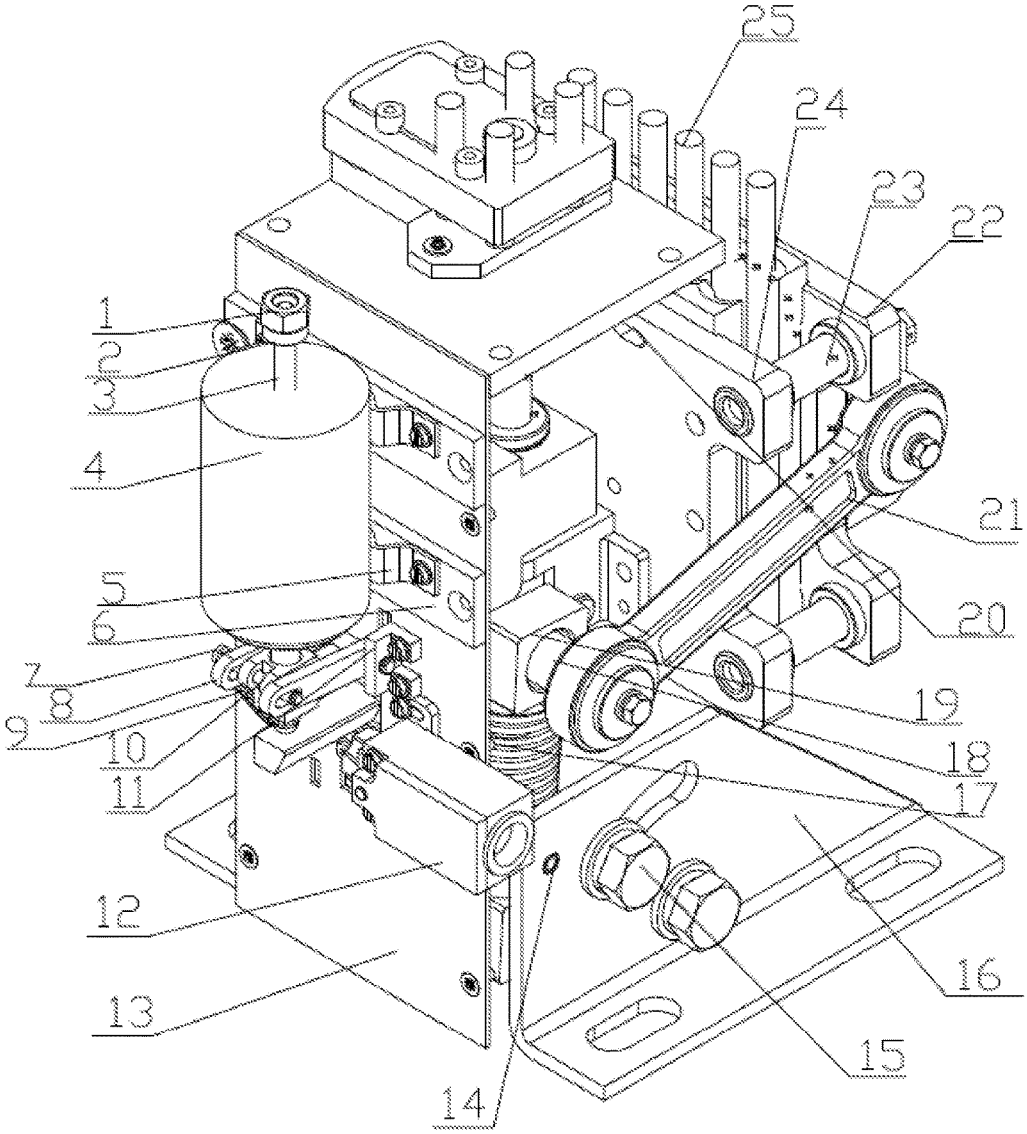
FIG. 2 is a structural isometric (partial) view of the steel wire rope brake according to the present invention.

In FIGs., 1 fixed nut, 2 buffer cushion, 3 impact bar, 4 electromagnet, 5 electromagnet seat, 6 fixed plate, 7 pin shaft, 8 support rod, 9 tension spring, 10 spring guide holder, 11 support, 12 safety switch, 13 rear side plate, 14 fixed pin, 15 adjusting screw, 16 mounting plate, 17 energy storage spring, 18 sliding axle, 19 spring seat, 20 brake lining adjusting hole, 21 link arm, 22 moving brake plate, 221 moving brake plate table facet, 23 guiding shaft, 24 fixed brake plate, 25 steel wire rope, 26 side plate, 27 guide rail, 28 slide block, 29 latch hook, 30 latch hook rack, 31 fixed axle plate, 32 link arm shaft, 33 push block, 34 screw, 35 brake lining, 351 brake lining table facet, 36 lead screw, 37 motor, 38 coupled axle-sleeve, 39 motor mounting plate, 40 gear reducer, and 41 top plate;

4-1 compression spring, 4-2 iron core, 4-3 external housing of the electromagnet, 4-4 buffer cushion, 4-5 impact screwhead; 311 fixed pin, 312 fastening screw, 313 support pin, 314 adjusting shim, 161 pivot screw, 191 spring seat, 192 spring support shaft, 291 latch hook impact plane, 292 safety switch impact plane, 293 latch hook straight slope, 294 latch hook mounting hole, 295 latch hook arc surface, 296 hook trough, 221 brake plate table facet, 222 brake port, 261 fixed plate connecting hole, 262 open arc, 263 pin, 264 deflection locking threaded hole, 265 spring seat axle hole, and 266 deflection axle hole.

DETAILED DESCRIPTION OF THE EMBODIMENTS

The following describes in detail preferred embodiments of the present invention with reference to the accompanying drawings.

As shown in FIG. 1-11, this embodiment includes a motor lead screw and push block resetting mechanism, an electromagnet resetting mechanism, friction moving/fixed brake lining plate mechanisms, an electromagnetic triggering mechanism and so on, and a connection relationship thereof is as below: the motor lead screw and push block resetting mechanism is mounted between an upper top plate and the latch hook rack, the electromagnet resetting mechanism is connected to the motor lead screw and push block resetting mechanism, the friction moving/fixed brake lining plate mechanisms are mounted on the moving/fixed brake plates, and the electromagnetic triggering mechanism is mounted on the rear side plate. A specific structure is as below:

The top plate 41 is mounted on an upper part of the steel wire rope brake, two side plates 26 are respectively mounted on the mounting plate 16 at two sides of the steel wire rope brake, the mounting plate 16 is fixedly mounted on a cross beam through bottom mounting holes, and the rear side plate 13 is mounted on the rear side surface (one side opposite to the steel wire rope) of the steel wire rope brake, thereby constituting a frame of the steel wire rope brake.

A mounting base includes the mounting plate 16, the adjusting screw 15, the fixed pin 14 and so on. After the mounting plate 16 is vertically mounted on the cross beam of an elevator car, the mounting plate 16 is connected into the deflection axle hole 266 of the side plate 26 through the pivot screw 161 on its side, so that the side plate 26 may rotate around the pivot screw 161. After the side plate 26 rotates at an angle of 0-45 degrees, the side plate 26 is locked by connecting the adjusting screw 15 to the deflection locking threaded hole 264 of the side plate 26, then a hole is drilled on the side plate 26 through the pin hole by using an electric drill, then the fixed pin 14 is inserted into the hole, or the mounting plate 16 is welded onto the side plate 26 to prevent the side plate 26 from rotating around the pivot screw 161 in a brake process. In the above connection structure, the adjustment of an angle between the brake plates and the steel wire is achieved by adjusting the mounting angle of the side plate 26, after being adjusted in place, the side plate 26 is fixed.

The motor lead screw and push block resetting mechanism includes the pin shaft 7, the support rod 8, the tension spring 9, the spring guide holder 10, the support 11, the energy storage spring 17, the sliding axle 18, the spring seat 19, the guide rail 27, the slide block 28, the latch hook 29, the latch hook rack 30, the push block 33, the screw 34, the lead screw 36, the motor 37, the coupled axle-sleeve 38, the motor mounting plate 39, the gear reducer 40 and so on. The motor mounting plate 39 is mounted on the top plate 41, the gear reducer 40 is mounted on the motor mounting plate 39, the gear reducer 40 is driven by the motor 37 to run, and the external housing of the motor 37 is fixed to the motor mounting plate 39. The transmission shaft of the gear reducer 40 is linked with the upper end of the lead screw 36 by connecting with the coupled axle-sleeve 38, the other end of the lead screw 36 forms an external thread and is screwed with the screw 34, and after this end of the lead screw 36 movably penetrates through the push block 33, the lead screw 36 is rotatably positioned on the latch hook rack 30. The screw 34 is fixedly mounted on the upper surface of the push block 33, the lead screw 36 is driven by the motor 37 to rotate, and pushes the screw 34 to move through the external thread, and then enables the push block 33 to move.

The push block 33 is fixedly connected with the slide block 28, the guide rail 27 longitudinally penetrates through the slide block 28 and is in sliding fit with the slide block 28. The guide rail 27 is mounted on the rear side plate 13 to form guiding and bearing. While the screw 34 moves, it drives the slide block 28 to move on the guide rail 27.

The bottom end of the push block 33 forms an inclined plane which directly faces the sliding axle 18 which transversally penetrates through two spring seats 19, and two ends of the sliding axle 18 are respectively placed into an open arc groove 262 formed by the two side plates in a sliding way.

The energy storage mechanism includes the spring 17, two spring seats 191 and the spring support shaft 192, between the left and the right side plates 26 there is mounted the spring support shaft 192, two ends of the spring support shaft 192 are respectively mounted in the spring seat axle hole 265 of the two side plates, the two spring seats 191 are mounted on the spring support shaft 192, two spring seats 191 are corresponding to two spring seats 19 on the upper part, and between the corresponding spring seats 19 and 191 there is respectively provided with one energy storage spring 17.

The fixed brake plate 24 is mounted on the two left and right side plates 26, and the connection structure is as below: each of the two side plates 26 is provided with a pin 263, correspondingly, pin holes are formed on the fixed brake plate 24, first, pin holes on the fixed brake plate 24 are positioned through the pin 263, then are connected through the fixed plate connecting holes 261. A plurality of fixed plate connecting holes 261 are respectively formed at a front side edge of each of the two side plates 26, the front side edges of the two side plates 26 fit with the fixed brake plate 24, and the side plates 26 are connected to the fixed brake plate 24 by screws, namely, bolts penetrate through the fixed brake plate 24 and then are screwed into the fixed plate connecting holes 261. The latch hook rack 30 is fixedly mounted on an inner side surface of the fixed brake plate 24, the latch hook rack 30 rotatably assembles the latch hook 29 through the pin shaft. The latch hook 29 forms the hook trough 296 corresponding to an external wall of the sliding axle 18, which can hook or release the sliding axle 18. The other end (outside end) of the latch hook 29 movably stretches out of the rear side plate 13, and this end directly faces the lower end of the impact bar 3.

The motor 37 starts to run after power is supplied, power is transmitted to the lead screw 36 through an output shaft of the gear reducer 40, then makes screw 34 move on the lead screw 36 to drive the push block 33 to move, the sliding axle 18 is compressed through the inclined surface of the push block 33, the sliding axle 18 implements compression of the energy storage spring 17 by means of the spring seat 19; after the energy storage spring is in place, the latch hook hooks the sliding axle, and the motor reverses to the initial state, thereby implementing the automatic resetting of the steel wire rope brake.

Assembly structures of the pin shaft 7, the support rod 8, the tension spring 9, the spring guide holder 10 and the supports 11 or the like are seen below.

The electromagnet resetting mechanism includes the pin shaft 7, the support rod 8, the tension spring 9, the spring guide holder 10 and the supports 11. A pair of supports 11 are mounted on the rear side plate 13, one support rod 8 that can rotate is mounted on the each support 11, the other end of (outside end) of the support rod 8 forms a pin hole, the pin shaft 7 transversely penetrates through the pin holes of the two support rods 8, one end of the pin shaft 7 positioned outside of one support rod 8 is connected to one end of the tension spring 9, the other end of the tension spring 9 is connected to the outside end of the latch hook 29 to implement resetting of the latch hook 29. One section of the pin shaft 7 positioned between the two support rods 8 is connected to the spring guide holder 10 which is connected to the lower end of the impact bar 3, and a part of the impact bar 3 is externally sleeved with the compression spring. Two holes are formed on the rear side plate 13, each hole is used for movably up and down penetrating through the inside end of one support rod 8, and the inside end of the support rod 8 bulges upward and directly faces the lower surface of the slide block 28. When the slide block 28 moves downward, the lower surface of the slide block 28 props against the inside end of the support rod 8 to make the support rod 8 swing, so that the spring guide holder 10 is linked by means of the action of the support rod 8, drives the impact bar 3 to move upward to compress the spring on the impact bar of the electromagnet. After the spring is compressed, an external power source supplies power to the electromagnet, and spring force is maintained by means of electromagnetic force to implement resetting of the power-losing electromagnet.

In the process of rotation of the motor, the push block connected with the screw moves to a preset position and comes into contact with the inside end of the support rod; when the push block moves to the preset position, the support rod is pushed to rotate to drive the spring guide holder to move. Compression of the spring on the impact bar of the electromagnet is implemented by driving the impact bar to move by the spring guide holder mounted on the impact bar. After compression of the spring is in place, the tension spring pulls the outside end of the latch hook until the sliding axle is locked, at the moment, the motor reverses, and the support restores its initial state due to loss of overhead pressure. In this way, it is implemented the automatic resetting of the power-losing electromagnet.

The friction moving/fixed brake plate mechanism includes the guiding shaft 23, the fixed brake plate 24, the moving brake plate 22 and the brake lining 35, where the fixed brake plate 24 and the moving brake plate 22 are longitudinally arranged in parallel, opposite surfaces of both are provided with the brake lining 35, and the moving brake plate 22 is the same as the brake lining 35 in assembly structure. The following describes in detail the assembly structure of the moving brake plate 22 and the brake lining 35: one side face of the moving brake plate 22 (toward the fixed brake plate 24) forms two cuboid-shaped recessed parts respectively extending to an upper edge and a lower edge of the moving brake plate 22, two side edges of each of the recessed parts are brake plate table facets 221, and the same side of each of the two recessed parts is provided with a brake lining adjusting hole 20 (an elongated hole is selected in this embodiment so that multiple bolts can be screwed); correspondingly, the brake lining 35 forms the recessed part whose edge is a brake lining table facet 351 fitting with the brake plate table facets 221, the brake lining 35 is embedded between the two recessed parts of the moving brake plate 22, and the table facets both come into contact, a width of the table facets 221 at two sides fits with that of the brake lining 35, and both are fixed by screwing bolts into the brake lining adjusting holes 20. The brake surface of the brake lining 35 forms a longitudinal arc-shaped groove fitting with an external shape of the steel wire rope, and protrudes out of the side surface of the moving brake plate 22. The brake lining 35 on the two brake plates 22 and 24 forms longitudinal arc-shaped grooves corresponding to the steel wire ropes in number, the steel wire rope 25 penetrate the corresponding longitudinal arc-shaped groove, and in a normal state, a clearance is kept between the longitudinal arc-shaped groove and the steel wire rope 25.

The above involve the case where one brake lining is used, where the number of the arc-shaped grooves may be combined to use according to needs so as to meet requirements for different numbers of the arc-shaped grooves. As a preferred technical solution of the present invention, multiple brake linings are selected and combined. As shown in FIGS. 7*a*, 7*b*, 7*c*, 7*d* and 7*e*, the first brake lining has two arc-shaped grooves, and the second brake lining has three arc-shaped grooves, and five arc-shaped grooves are formed by combination of both, which fits with five steel wires. The brake linings are mutually matched and fixed through stepped surfaces. The brake linings are combined to fit with different numbers of steel wire ropes without replacing brake plates.

Two fixed axle plates 31 are mounted the outer side surface of the moving brake plate 22 through the fastening screw 312, and the adjusting shim 314 is provided between the fixed axle plate 31 and the moving brake plate 22. The link arm shaft 32 penetrates through the two fixed axle plates 31 and is fixed by means of the fixed pin 311 to prevent it from rotating. The moving brake plate 22 is also provided with two support pins 313 which face an outside of the moving brake plate 22 and are positioned below the link arm shaft 32 to prevent the link arm shaft 32 from sliding down in a brake process by means of the supporting action of the support pins 313. The adjusting shim 314 is mounted between the fixed axle plate 31 and the moving brake plate 22 to adjust the height of the sliding axle 18. It is implemented different magnification ratios and spring forces by adjusting the height of the sliding axle 18 to meet requirements for quality of different braking systems.

The guiding shaft 23 is connected to the fixed brake plate 24 and the moving brake plate 22. Each of four corners of the moving brake plate 22 is provided with a hole 222, correspondingly, each of four corners of the fixed brake plate 24 is also provided with a hole, a corresponding hole is connected with the guiding shaft 23, the guiding shaft 23 is fixedly connected with the moving brake plate 22 and is in sliding fit with the fixed brake plate 24, or vice versa, namely, the guiding shaft 23 is in sliding fit with the moving brake plate 22 and is fixedly connected with the fixed brake plate 24.

The outer side surface of the moving brake plate 22 is fixedly connected with the fixed axle plate 31 which is provided with the link arm shaft 32, two ends of the link arm shaft 32 stretches out of the fixed axle plate 31, and end parts thereof are respectively and rotatably matched with one end of the link arm 21. The other end of the link arm 21 is rotatably matched with the sliding axle 18.

Figure 3:
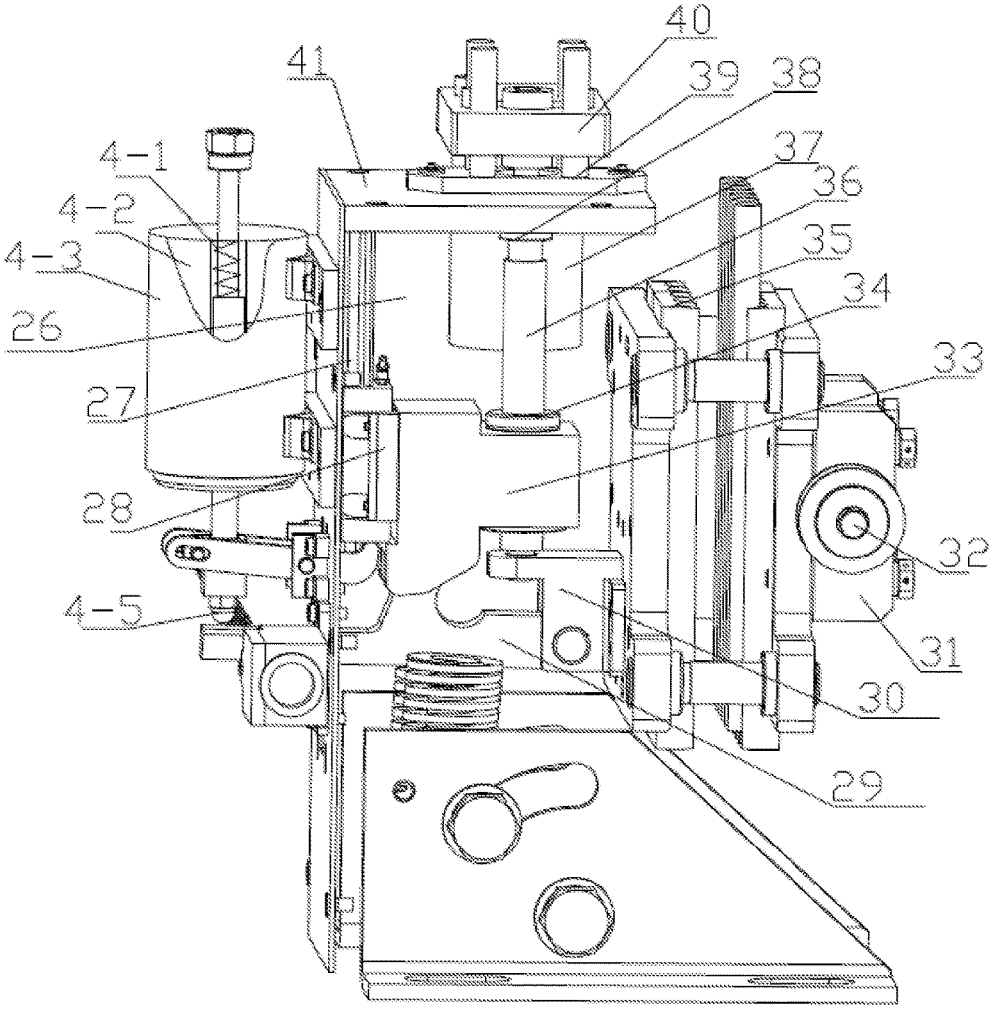
FIG. 3 is a structural lateral (partial) view of the steel wire rope brake according to the present invention.
Figure 4:
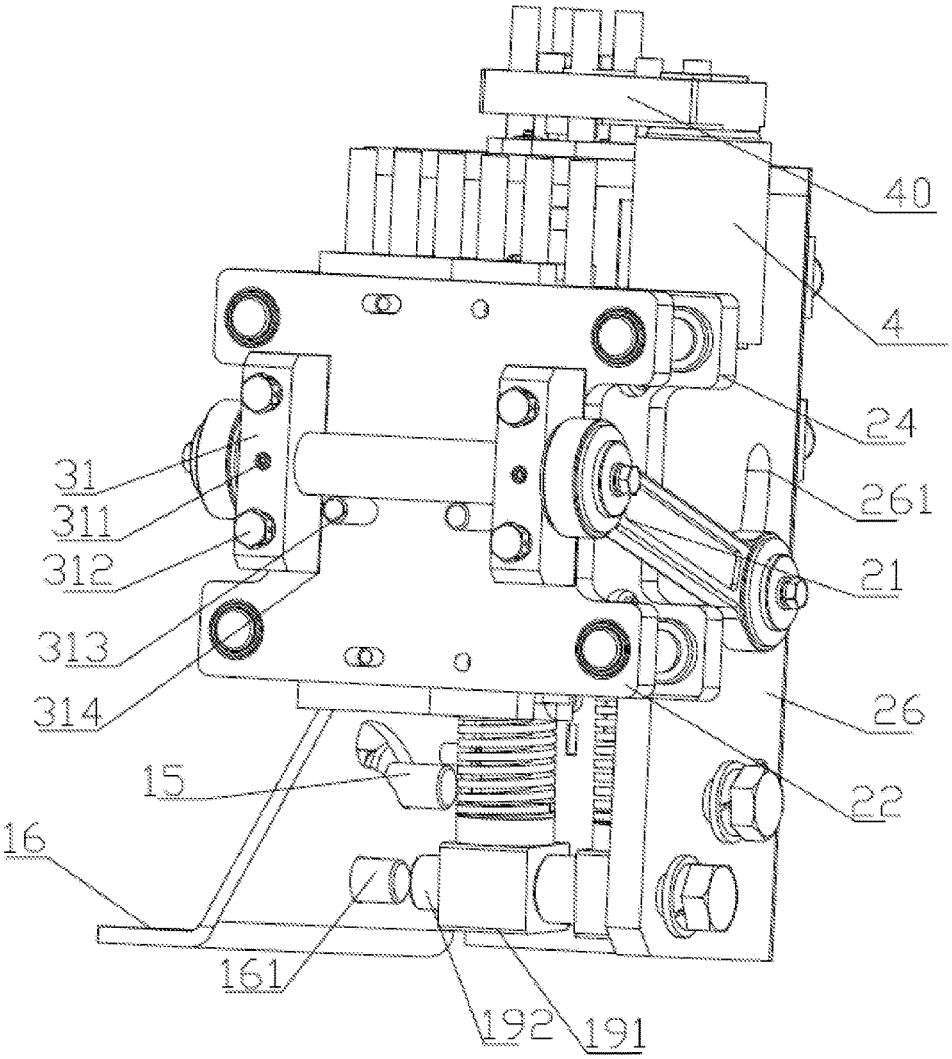
FIG. 4 is a structural rear (partial) view of the steel wire rope brake according to the present invention.
Figure 5:
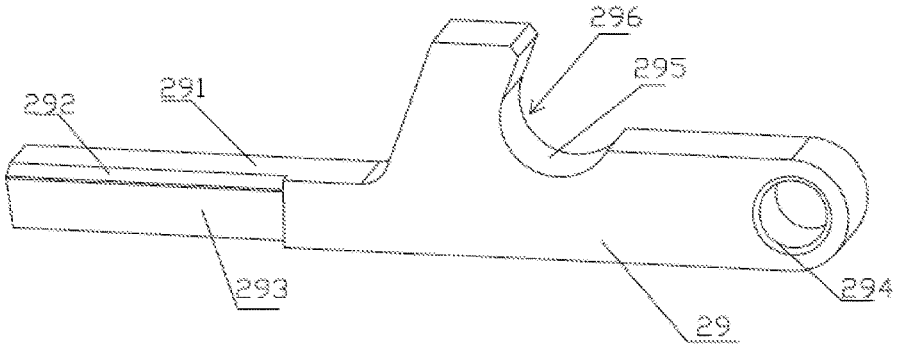
FIG. 5 is a structural diagram of a latch hook according to the present invention.
Figure 6:
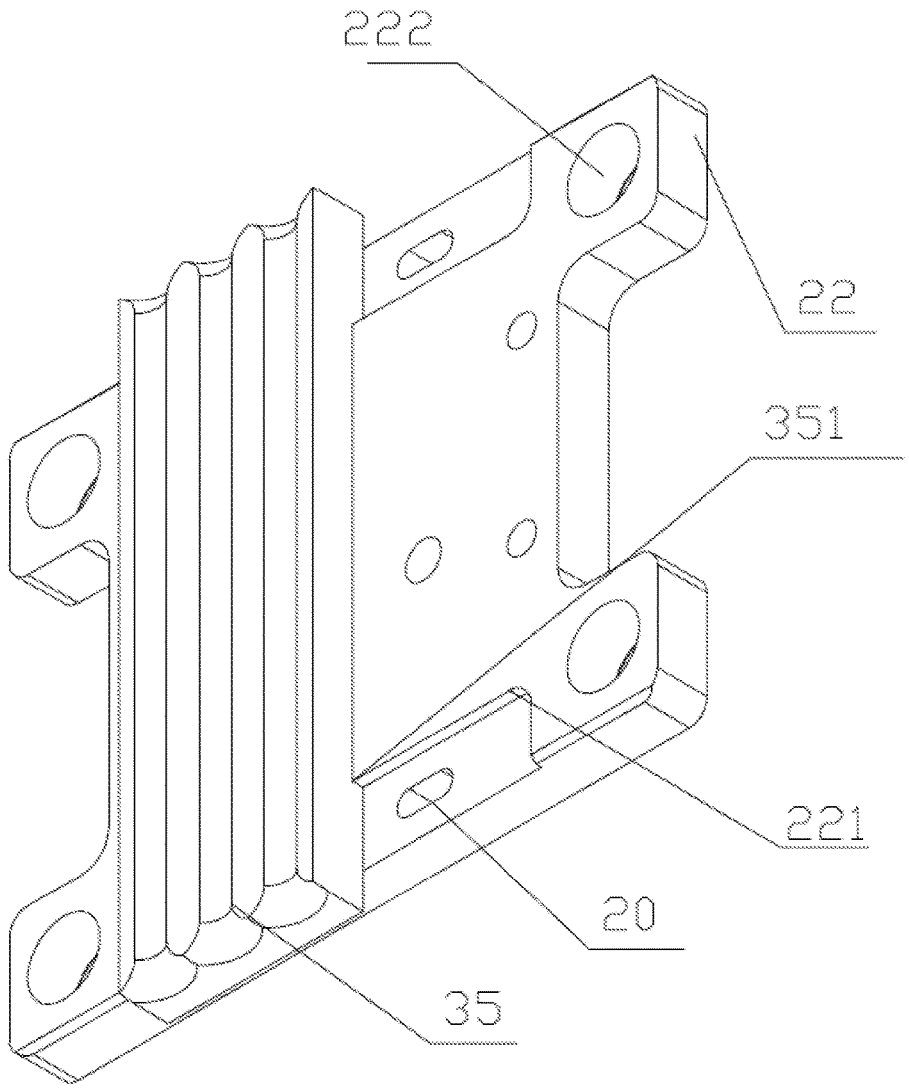
FIG. 6 is a structural assembly diagram of a brake plate and a brake lining according to the present invention.
Figure 7A:
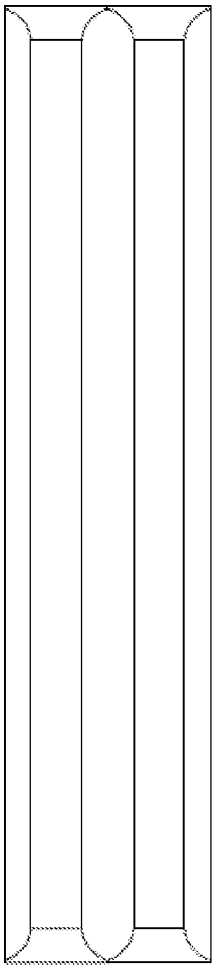
FIG. 7*a* and FIG. 7*b* are a principal view and a vertical view of a brake lining according to the present invention.
Figure 7C:
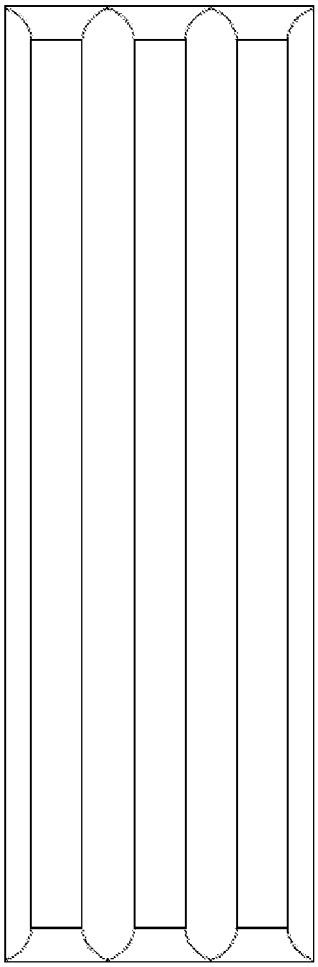
FIG. 7*c* and FIG. 7*d* are a principal view and a vertical view of another brake lining according to the present invention.
Figure 7E:
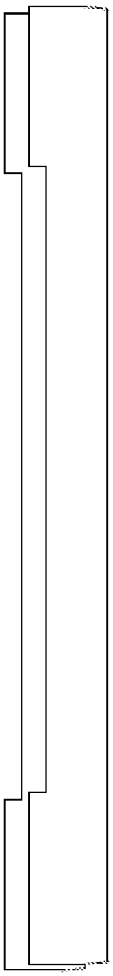
FIG. 7*e* is a side view of a brake lining according to the present invention.
Figure 7B:
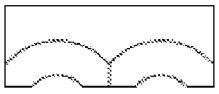
Figure 7D:
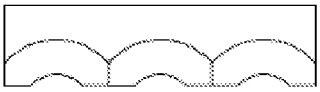
Figure 8:
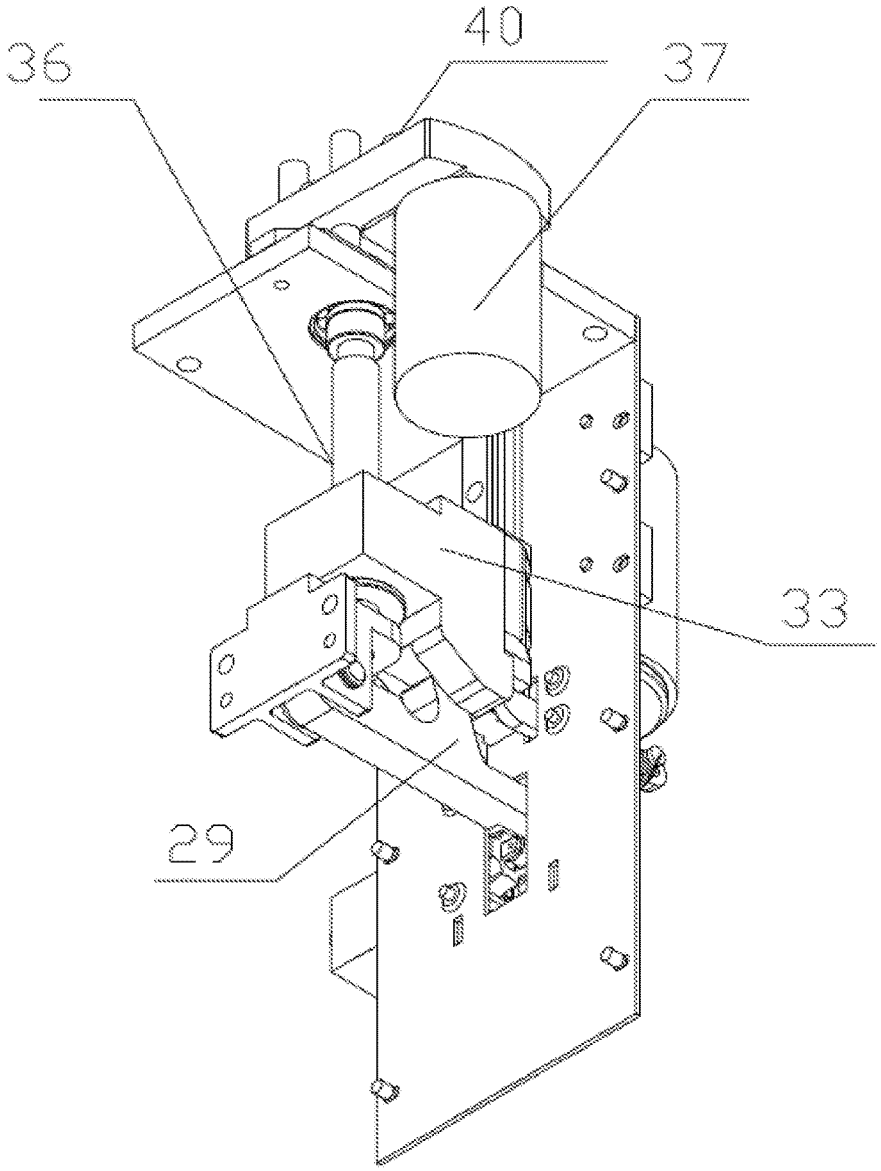
FIG. 8 is a tridimensional structural diagram of a motor resetting mechanism according to the present invention.
Figure 9:
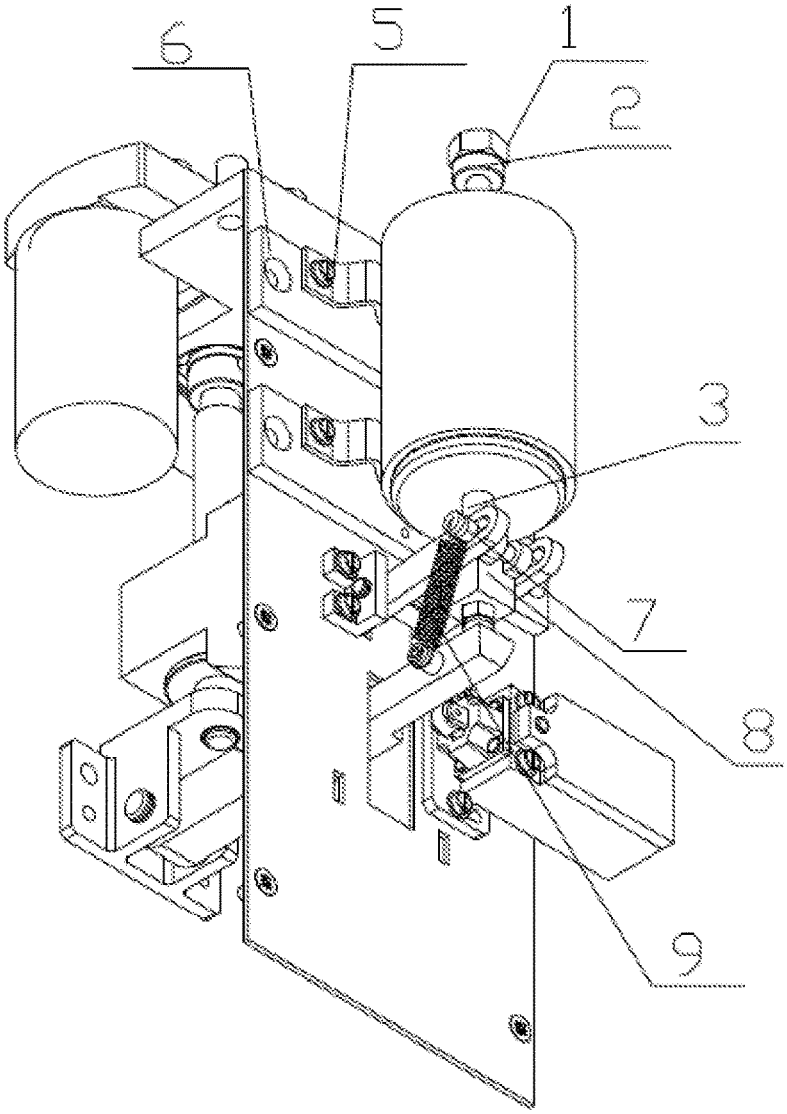
FIG. 9 is a tridimensional structural diagram of an electromagnetic triggering mechanism according to the present invention.
Figure 10:
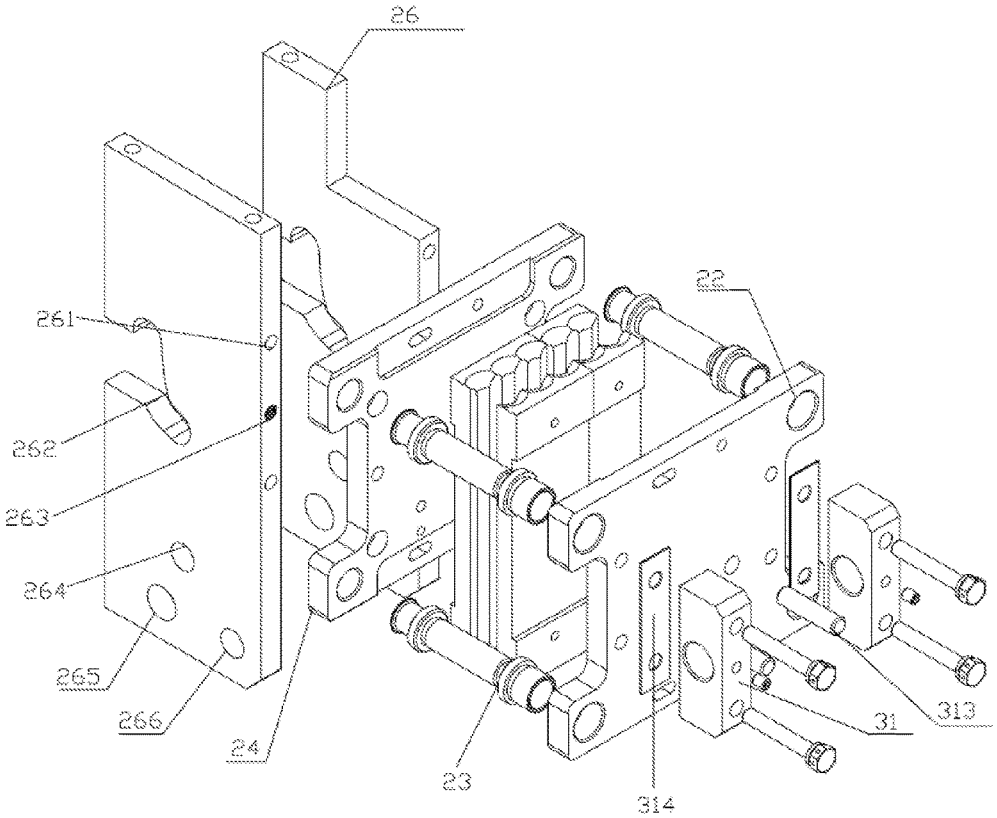
FIG. 10 is an installation drawing of a brake body according to the present invention.
Figure 11:
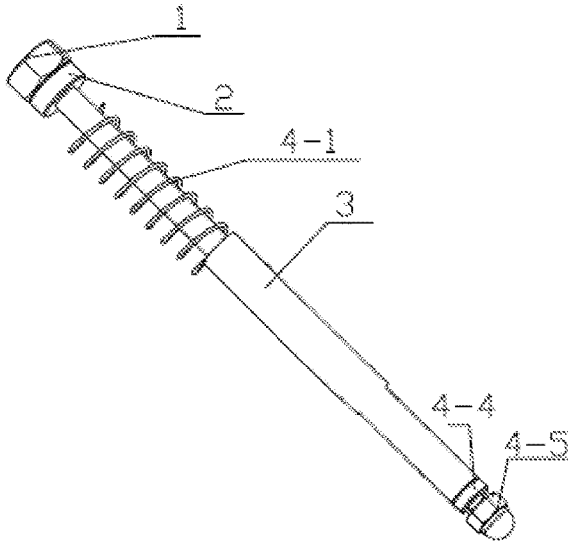
FIG. 11 is a structural diagram of an impact bar according to the present invention.

The electromagnetic triggering mechanism includes the electromagnet 4, the impact bar 3, the fixed nut 1, the buffer cushion 2, the electromagnet seat 5 and the fixed plate 6, where the fixed plate 6 is mounted on the rear side plate 13, the electromagnet seat 5 is mounted on the fixed plate 6 through bolts, and the electromagnet 4 is mounted on the electromagnet seat 5. The iron core of the electromagnet 4 is linked with the impact bar 3 which moves together with the iron core, and a part of the impact bar 3 is externally sleeved with the compression spring (FIG. 3). The spring 4-1 is externally sleeved on a part of the impact bar 3 which longitudinally penetrates through the iron core 4-2 of the electromagnet, the upper end of the impact bar is provided with the buffer cushion 2 and then is fixed by means of the fixed nut 1 to prevent the impact bar 3 from falling off during impact; and the lower end of the impact bar is provided with the buffer cushion 4-4 and then is fixed through the impact screwhead 4-5 to prevent an impact in an ascending resetting process.

The latch hook 29 forms a latch hook impact plane 291, a safety switch impact plane 292, a latch hook straight slope 293, a latch hook mounting hole 294, a latch hook arc surface 295 and a hook trough 296. The latch hook is mounted on the latch hook rack 30 through the latch hook mounting hole 294. When the impact bar 3 impacts the latch hook impact plane 291, the latch hook 29 rotates around the latch hook rack 30 to make the straight slope 293 slide so that the hook trough 296 releases the locking of the sliding axle 18, and at the moment, the safety switch impact plane 292 of the latch hook that is moving downward triggers the safety switch 12. During resetting, the latch hook moves upward, the latch hook arc surface 295 comes in contact with the sliding axle 18 so that the hook trough 296 locks the sliding axle 18; when the motor 37 returns back, the sliding axle 18 moves upward under the action of the energy storage spring 17 so that the latch hook arc surface 295 comes in contact with the sliding axle 18, and at the moment, the latch hook is unable to rotate, thereby locking the sliding axle 18.

When the electromagnet 4 loses power, the electromagnet 4 loses electromagnetic force, driven by the compression spring, the impact bar 3 conducts a downward impact movement and produces an impact effect by means of spring force and self weight, so that the latch hook 29 trips off and releases the compressed energy storage spring 17.

The safety switch 12 is mounted on the rear side plate 13, when the impact bar 3 of the electromagnet impacts the latch hook 29, the latch hook 29 moves downward to turn on the safety switch 12. Control of the whole elevator is implemented by the safety switch 12 being connected to an elevator safety circuit. The safety switch impact plane 292 touches a contact of the safety switch 12 which is connected to a safety circuit of an elevator control system, and the system stops working once the safety circuit is disconnected.

Reference is made to Brake For Traction Cable Of Elevator (Patent Number: ZL200510061286.5) regarding other contents of the steel wire rope brake of the present invention, which is not detailed herein.

The automatic resetting steel wire rope brake of the present invention includes: a motor lead screw and push block resetting mechanism, friction moving/fixed brake lining plate mechanisms, an electromagnetic triggering mechanism, an electromagnet automatic resetting mechanism and so on. The automatic resetting steel wire rope brake is a safety protection device that updates the function of the original safety device of up-direction over speeding to implement combination of upward overspeed protection and car accidental movement protection. It is improved from electric triggering to power-loss triggering, and elevator upward overspeed protection and car accidental movement protection are achieved by using the motor lead screw and push block resetting mechanism, the friction moving/fixed brake lining plate mechanisms, the electromagnet automatic resetting mechanism and a controller. In case of upward overspeed or car accidental movement, by means of logical relation operation of the controller, a control signal is outputted to make the electromagnet of the electromagnetic triggering mechanism lose power to trigger the latch hook of the steel wire rope brake to act. During resetting, the motor of the motor lead screw and push block resetting mechanism is energized, the sliding axle, a linkage mechanism and the electromagnet resetting mechanism are compressed by the push block to implement automatic resetting of the energy storage spring, the latch hook and the electromagnet. The automatic resetting steel wire rope brake in the present invention is perfect in function, quick in response, stable and controllable, convenient for installation, and low in manufacturing cost, etc.

The above describes in details preferred embodiments of the present invention, however, to those of ordinary skill in the art, the embodiments may be changed in according with the thought provided by the present invention, and these changes shall also be regarded as the scope of protection of the present invention.

The invention claimed is:

1. An automatic resetting steel wire rope brake, comprising two side plates, a fixed brake plate, a moving brake plate, a motor lead screw and push block resetting mechanism, an electromagnet resetting mechanism and an electromagnetic triggering mechanism, the fixed brake plate and the moving brake plate are arranged in parallel, and an interval is kept between opposite clamping surfaces of the fixed brake plate and the moving brake plate; two sides of the moving brake plate are respectively and rotatably matched with one end of a link arm, and the moving brake plate can do translational motion towards or away from the fixed brake plate under a drive of the two link arms; the other end of each of the two link arms is rotatably matched with one end of a sliding axle; two ends of the sliding axle are respectively in sliding fit with arc-shaped grooves of the two side plates; a swing-type latch hook is provided, and the latch hook forms a hooking part used for hooking and locking a sliding axle; a swing end of the latch hook is triggered by an electromagnetic or mechanical triggering mechanism to enable the swing end to release the sliding axle; the electromagnetic triggering mechanism, the latch hook, the sliding axle and the moving brake plate are promoted to reset by the motor lead screw and push block resetting mechanism through the electromagnet resetting mechanism; the motor lead screw and push block resetting mechanism comprises a push block, a screw, a lead screw and a motor, the motor drives an upper end of lead screw, a lower end of the lead screw is rotatably connected with the screw and movably penetrate through the push block, the screw is fixed on an upper surface of the push block, and a bottom inclined surface of the push block directly faces and props against the sliding axle, wherein the electromagnetic triggering mechanism comprises an electromagnet, an impact bar, a nut and a buffer cushion, the impact bar longitudinally penetrates through an iron core of the electromagnet, the iron core of the electromagnet is linked with the impact bar, a part of the impact bar is externally sleeved with a compression spring, an upper end of the impact bar is provided with the buffer cushion and is screwed with the nut, the buffer cushion directly faces an upper surface of an external housing of the electromagnet; and a lower end of the impact bar is provided with the buffer cushion and an impact screwhead which directly faces and downward props against the swing end of the latch hook.

2. The automatic resetting steel wire rope brake according to claim 1, wherein a safety switch is provided, when the impact bar of the electromagnet impacts the latch hook, the latch hook moves down to turn on the safety switch, and is connected to an elevator safety circuit by means of the safety switch; a rear side surface of the steel wire rope brake is provided with a rear side plate on which the safety switch is mounted; the electromagnet is mounted on an electromagnet seat, and the electromagnet seat is mounted on a fixed plate which is mounted on the rear side plate.

3. An automatic resetting steel wire rope brake, comprising two side plates, a fixed brake plate, a moving brake plate, a motor lead screw and push block resetting mechanism, an electromagnet resetting mechanism and an electromagnetic triggering mechanism, the fixed brake plate and the moving brake plate are arranged in parallel, and an interval is kept between opposite clamping surfaces of the fixed brake plate and the moving brake plate; two sides of the moving brake plate are respectively and rotatably matched with one end of a link arm, and the moving brake plate can do translational motion towards or away from the fixed brake plate under a drive of the two link arms; the other end of each of the two link arms is rotatably matched with one end of a sliding axle; two ends of the sliding axle are respectively in sliding fit with arc-shaped grooves of the two side plates; a swing-type latch hook is provided, and the latch hook forms a hooking part used for hooking and locking a sliding axle; a swing end of the latch hook is triggered by an electromagnetic or mechanical triggering mechanism to enable the swing end to release the sliding axle; the electromagnetic triggering mechanism, the latch hook, the sliding axle and the moving brake plate are promoted to reset by the motor lead screw and push block resetting mechanism through the electromagnet resetting mechanism; the motor lead screw and push block resetting mechanism comprises a push block, a screw, a lead screw and a motor, the motor drives an upper end of lead screw, a lower end of the lead screw is rotatably connected with the screw and movably penetrate through the push block, the screw is fixed on an upper surface of the push block, and a bottom inclined surface of the push block directly faces and props against the sliding axle, wherein the push block is fixedly connected with a slide block, a guide rail longitudinally penetrates through the slide block and is in sliding fit with the slide block; the electromagnet resetting mechanism comprises a pin shaft, a support rod, a tension spring, a spring guide holder and a support on which the support rod that can rotate is mounted, an external end of the support rod forms a pin hole, the pin shaft transversely penetrates through the pin hole of the support rod, one end of the pin shaft is connected to one end of the tension spring, the other end of the tension spring is connected to the swing end of the latch hook; the pin shaft is also connected to the spring guide holder which is connected to a lower end of the impact bar; and an inner end of the support rod directly faces a lower surface of the slide block, and when the slide block moves downward, the lower surface of the slide block props against the inner end of the support rod to make the support rod swing.

4. An automatic resetting steel wire rope brake, comprising two side plates, a fixed brake plate, a moving brake plate, a motor lead screw and push block resetting mechanism, an electromagnet resetting mechanism and an electromagnetic triggering mechanism, the fixed brake plate and the moving brake plate are arranged in parallel, and an interval is kept between opposite clamping surfaces of the fixed brake plate and the moving brake plate; two sides of the moving brake plate are respectively and rotatably matched with one end of a link arm, and the moving brake plate can do translational motion towards or away from the fixed brake plate under a drive of the two link arms; the other end of each of the two link arms is rotatably matched with one end of a sliding axle; two ends of the sliding axle are respectively in sliding fit with arc-shaped grooves of the two side plates; a swing-type latch hook is provided, and the latch hook forms a hooking part used for hooking and locking a sliding axle; a swing end of the latch hook is triggered by an electromagnetic or mechanical triggering mechanism to enable the swing end to release the sliding axle; the electromagnetic triggering mechanism, the latch hook, the sliding axle and the moving brake plate are promoted to reset by the motor lead screw and push block resetting mechanism through the electromagnet resetting mechanism; the motor lead screw and push block resetting mechanism comprises a push block, a screw, a lead screw and a motor, the motor drives an upper end of lead screw, a lower end of the lead screw is rotatably connected with the screw and movably penetrate through the push block, the screw is fixed on an upper surface of the push block, and a bottom inclined surface of the push block directly faces and props against the sliding axle, wherein an outer side surface of the moving brake plate is provided with two fixed axle plates, a link arm shaft penetrates through the two fixed axle plates and is fixedly connected by means of a fixed pin; the moving brake plate is also provided with a support pin which faces an outside of the moving brake plate and is positioned below the link arm shaft to prevent the link arm shaft from sliding down in a brake process; an adjusting shim is provided between the fixed axle plate and the moving brake plate.

5. The automatic resetting steel wire rope brake according to claim 4, wherein the sliding axle transversely penetrates through an upper spring seat; between the two side plates there is provided a spring support shaft on which a lower spring seat is mounted, the upper spring seat is corresponding to the lower spring seat in upper and lower positions, and an energy storage spring is provided between the upper spring seat and the lower spring seat.

6. The automatic resetting steel wire rope brake according to claim 4, wherein the fixed brake plate is fixedly provided with a latch hook rack which rotatably assembles the latch hook through the pin shaft.

7. The automatic resetting steel wire rope brake according to claim 4, wherein the moving brake plate is fixedly connected to two fixed axle plates, a link arm shaft is assembled between the two fixed axle plates, and two ends of the link arm shaft are respectively and rotatably matched with one end of the two link arms.

8. The automatic resetting steel wire rope brake according to claim 4, wherein the fixed brake plate is connected with the moving brake plate through a guiding shaft.

9. An automatic resetting steel wire rope brake, comprising two side plates, a fixed brake plate, a moving brake plate, a motor lead screw and push block resetting mechanism, an electromagnet resetting mechanism and an electromagnetic triggering mechanism, the fixed brake plate and the moving brake plate are arranged in parallel, and an interval is kept between opposite clamping surfaces of the fixed brake plate and the moving brake plate; two sides of the moving brake plate are respectively and rotatably matched with one end of a link arm, and the moving brake plate can do translational motion towards or away from the fixed brake plate under a drive of the two link arms; the other end of each of the two link arms is rotatably matched with one end of a sliding axle; two ends of the sliding axle are respectively in sliding fit with arc-shaped grooves of the two side plates; a swing-type latch hook is provided, and the latch hook forms a hooking part used for hooking and locking a sliding axle; a swing end of the latch hook is triggered by an electromagnetic or mechanical triggering mechanism to enable the swing end to release the sliding axle; the electromagnetic triggering mechanism, the latch hook, the sliding axle and the moving brake plate are promoted to reset by the motor lead screw and push block resetting mechanism through the electromagnet resetting mechanism; the motor lead screw and push block resetting mechanism comprises a push block, a screw, a lead screw and a motor, the motor drives an upper end of lead screw, a lower end of the lead screw is rotatably connected with the screw and movably penetrate through the push block, the screw is fixed on an upper surface of the push block, and a bottom inclined surface of the push block directly faces and props against the sliding axle, wherein the fixed brake plate is mounted on a left side plate and a right side plate; each of the two side plates is provided with a pin, correspondingly, pin holes are formed on the fixed brake plate, and the pins are corresponding to and fixedly connected with the pin holes on the fixed brake plate; a plurality of fixed plate connecting holes are respectively formed at a front side edge of each of the two side plates, the front side edges of the two side plates fit with the fixed brake plate, and bolts penetrate through the fixed brake plate and then are screwed into the fixed plate connecting holes.

10. The automatic resetting steel wire rope brake according to claim 9, wherein the sliding axle transversely penetrates through an upper spring seat; between the two side plates there is provided a spring support shaft on which a lower spring seat is mounted, the upper spring seat is corresponding to the lower spring seat in upper and lower positions, and an energy storage spring is provided between the upper spring seat and the lower spring seat.

11. The automatic resetting steel wire rope brake according to claim 9, wherein the fixed brake plate is fixedly provided with a latch hook rack which rotatably assembles the latch hook through the pin shaft.

12. The automatic resetting steel wire rope brake according to claim 9, wherein the moving brake plate is fixedly connected to two fixed axle plates, a link arm shaft is assembled between the two fixed axle plates, and two ends of the link arm shaft are respectively and rotatably matched with one end of the two link arms.

13. The automatic resetting steel wire rope brake according to claim 9, wherein the fixed brake plate is connected with the moving brake plate through a guiding shaft.

14. An automatic resetting steel wire rope brake, comprising two side plates, a fixed brake plate, a moving brake plate, a motor lead screw and push block resetting mechanism, an electromagnet resetting mechanism and an electromagnetic triggering mechanism, the fixed brake plate and the moving brake plate are arranged in parallel, and an interval is kept between opposite clamping surfaces of the fixed brake plate and the moving brake plate; two sides of the moving brake plate are respectively and rotatably matched with one end of a link arm, and the moving brake plate can do translational motion towards or away from the fixed brake plate under a drive of the two link arms; the other end of each of the two link arms is rotatably matched with one end of a sliding axle; two ends of the sliding axle are respectively in sliding fit with arc-shaped grooves of the two side plates; a swing-type latch hook is provided, and the latch hook forms a hooking part used for hooking and locking a sliding axle; a swing end of the latch hook is triggered by an electromagnetic or mechanical triggering mechanism to enable the swing end to release the sliding axle; the electromagnetic triggering mechanism, the latch hook, the sliding axle and the moving brake plate are promoted to reset by the motor lead screw and push block resetting mechanism through the electromagnet resetting mechanism; the motor lead screw and push block resetting mechanism comprises a push block, a screw, a lead screw and a motor, the motor drives an upper end of lead screw, a lower end of the lead screw is rotatably connected with the screw and movably penetrate through the push block, the screw is fixed on an upper surface of the push block, and a bottom inclined surface of the push block directly faces and props against the sliding axle, wherein the motor drives the lead screw through a gear reducer, and a transmission shaft of the gear reducer is connected to an upper end of the lead screw by means of a coupled axle-sleeve.

15. The automatic resetting steel wire rope brake according to claim 14, wherein the sliding axle transversely penetrates through an upper spring seat; between the two side plates there is provided a spring support shaft on which a lower spring seat is mounted, the upper spring seat is corresponding to the lower spring seat in upper and lower positions, and an energy storage spring is provided between the upper spring seat and the lower spring seat.

16. The automatic resetting steel wire rope brake according to claim 14, wherein the fixed brake plate is fixedly provided with a latch hook rack which rotatably assembles the latch hook through the pin shaft.

17. The automatic resetting steel wire rope brake according to claim 14, wherein the moving brake plate is fixedly connected to two fixed axle plates, a link arm shaft is assembled between the two fixed axle plates, and two ends of the link arm shaft are respectively and rotatably matched with one end of the two link arms.

18. The automatic resetting steel wire rope brake according to claim 14, wherein the fixed brake plate is connected with the moving brake plate through a guiding shaft.

19. An automatic resetting steel wire rope brake, comprising two side plates, a fixed brake plate, a moving brake plate, a motor lead screw and push block resetting mechanism, an electromagnet resetting mechanism and an electromagnetic triggering mechanism, the fixed brake plate and the moving brake plate are arranged in parallel, and an interval is kept between opposite clamping surfaces of the fixed brake plate and the moving brake plate; two sides of the moving brake plate are respectively and rotatably matched with one end of a link arm, and the moving brake plate can do translational motion towards or away from the fixed brake plate under a drive of the two link arms; the other end of each of the two link arms is rotatably matched with one end of a sliding axle; two ends of the sliding axle are respectively in sliding fit with arc-shaped grooves of the two side plates; a swing-type latch hook is provided, and the latch hook forms a hooking part used for hooking and locking a sliding axle; a swing end of the latch hook is triggered by an electromagnetic or mechanical triggering mechanism to enable the swing end to release the sliding axle; the electromagnetic triggering mechanism, the latch hook, the sliding axle and the moving brake plate are promoted to reset by the motor lead screw and push block resetting mechanism through the electromagnet resetting mechanism; the motor lead screw and push block resetting mechanism comprises a push block, a screw, a lead screw and a motor, the motor drives an upper end of lead screw, a lower end of the lead screw is rotatably connected with the screw and movably penetrate through the push block, the screw is fixed on an upper surface of the push block, and a bottom inclined surface of the push block directly faces and props against the sliding axle, wherein a brake lining is respectively assembled on the clamping surface of the fixed brake plate and of the moving brake plate, and the two brake linings form longitudinal arc-shaped grooves fitting with an external shape of the steel wire rope, wherein the fixed brake plate and the moving brake plate form, toward an opposite side surface, two cuboid-shaped recessed parts respectively extending to an upper edge and a lower edge of the fixed brake plate and the moving brake plate, two side edges of each of the recessed parts are brake plate table facets, and a same side of each of the recessed parts is provided with a brake lining adjusting hole; correspondingly, the brake lining forms the recessed part whose edge is a brake lining table facet fitting with the brake plate table facets, the brake lining is embedded between the two recessed parts of the fixed brake plate and the moving brake plate, and the table facets both come into contact, a width of the table facet at two sides fits with that of the brake lining, and both are fixed by screwing bolts into the brake lining adjusting holes.

20. The automatic resetting steel wire rope brake according to claim 19, wherein the brake linings are formed by selecting and vertically and parallelly arranging multiple brake linings, and each of the brake linings is fixedly connected with the fixed brake plate and the moving brake plate through bolts; the brake lining adjusting hole is an elongated hole.

* * * * *